United States Patent [19]

Freed, Jr.

[11] 4,090,601

[45] May 23, 1978

[54] MINING MACHINE CONVEYOR AND APPARATUS FOR CONTROLLING THE TENSION THEREON

[75] Inventor: Donald L. Freed, Jr., Belleville, Ill.

[73] Assignee: National Mine Service Company, Pittsburgh, Pa.

[21] Appl. No.: 740,199

[22] Filed: Nov. 9, 1976

[51] Int. Cl.[2] ..... B65G 41/00

[52] U.S. Cl. ..... 198/316; 198/507; 198/813; 198/864

[58] Field of Search ..... 198/316, 317, 507, 512, 198/514, 813, 814, 864; 299/18, 56, 67

[56] References Cited

U.S. PATENT DOCUMENTS

| | | | |
|---|---|---|---|
| 2,527,452 | 10/1950 | Rose | 198/864 |
| 2,744,614 | 5/1956 | Sibley | 198/317 |
| 2,766,871 | 10/1956 | Arentzen | 198/864 |
| 2,785,789 | 3/1957 | Slomer | 198/813 |
| 2,808,920 | 10/1957 | Silver | 198/316 |
| 2,856,061 | 10/1958 | Seigle et al. | 198/733 |
| 2,875,885 | 3/1959 | Kilbourne | 198/512 |
| 2,895,591 | 7/1959 | Frellsen | 198/864 |
| 3,008,566 | 11/1961 | Biedess | 198/725 |
| 3,027,993 | 4/1962 | Houben | 198/813 |
| 3,134,479 | 5/1964 | Daily | 198/507 |

*Primary Examiner*—John J. Love
*Assistant Examiner*—Richard K. Thomson
*Attorney, Agent, or Firm*—Stanley J. Price, Jr.; John M. Adams

[57] ABSTRACT

A mining machine having a body portion mounted on propelling tracks includes an endless conveyor mechanism that extends longitudinally on the body portion. The conveyor mechanism is rotatably supported at the front and rear end portions thereof by roller assemblies. The rear roller assembly is longitudinally movable and driven by a hydraulically operated motor to advance the conveyor mechanism from a receiving end portion to a discharging end portion. The discharging end portion is supported for lateral swinging movement relative to the main conveyor portion. Hydraulically operated take-up devices are connected to the rear roller assembly and maintain a preselected tension on the conveyor to prevent slack developing therein. Each take-up device includes a cylinder with a rod having a shoulder portion of a preselected differential area against which fluid pressure is applied to extend the rod from the cylinder. The fluid pressure in each cylinder is supplied from the hydraulic circuitry of the conveyor drive motor. Thus, the cylinders are load sensitive so that an increase in the load on the conveyor drive motor, as when the conveyor is swung laterally, results in an increase in force upon the rear roller assembly to take-up the slack in the conveyor. This avoids excessive tension on the conveyor when the conveyor portions are aligned. Only that force required to prevent slack from developing is applied to the conveyor by the take-up devices.

9 Claims, 5 Drawing Figures

MINING MACHINE CONVEYOR AND APPARATUS FOR CONTROLLING THE TENSION THEREON

BACKGROUND OF THE INVENTION

1. Field of the Invention

This invention relates to a flexible chain conveyor for a mining machine and apparatus for controlling the tension on the conveyor and more particularly to a take-up cylinder that is hydraulically operated and responsive to the operating pressure of the conveyor drive motor so that only that force required to maintain the conveyor chain free of slack is applied thereto.

2. Description of the Prior Art

In transferring dislodged material rearwardly on a mining machine by a longitudinal conveyor, it is the conventional practice to provide a conveyor discharging end portion that is pivotally connected to the main conveyor and operable to swing laterally in controlling the discharge of material from the conveyor. U.S. Pat. No. 3,190,697 discloses such a laterally swingable conveyor on a continuous mining machine. There, cutting elements of the mining machine dislodge the solid material from the mine face and a flexible, continuous flight conveyor extending rearwardly of the cutting elements transports the dislodged material to a discharging end portion of the conveyor. The discharging end portion of the conveyor includes a boom member that is connected to the machine body portion. The boom member is operable by a piston cylinder assembly to swing laterally relative to the main conveyor so that the end conveyor may be maintained in material receiving relation with a conventional haulage vehicle as the mining machine is maneuvered through the mine.

A problem, however, is encountered in maintaining a preselected tension on the conveyor chain as it swivels laterally to take-up the slack in the conveyor. To overcome the problem of slack in the conveyor chain, take-up devices such as springs, which are rigidly secured to the conveyor support frame at one end and at the opposite end to the shaft of the rear sprocket of the conveyor, maintain the conveyor under tension when it is swung laterally to prevent slack developing in the conveyor. However, a spring by maintaining tension on the conveyor when swung laterally subsequently exerts an excessive amount of tension on the conveyor discharging end portion when it is aligned with the main portion of the conveyor. The tension exerted by the spring take-up is substantially more than is necessary to maintain the conveyor free of slack when the conveyor portions are aligned. Consequently, the increased tension on the components of the chain such as the chain links, load pan, return pan, drives and bearings accelerates the wear of these components requiring increased maintenance. Furthermore, the excessive tension exerted on the conveyor chain contributes to create undesirable chain noise.

The conveyor take-up spring is connected to the rear sprocket which is longitudinally movable in the conveyor support frame. It has been the practice to drive the conveyor from the front sprocket in which the drive is located in the gathering head. This drive arrangement, because of the size of the drive sprocket, limits the location of the forward end of the conveyor chain to a point further from the leading edge of the gathering head that is desirable for an efficient gathering operation. With a front drive arrangement, the entire conveyor chain from the drive sprocket to the rear idler sprocket or roller assembly and back through the lower conveyor run to the front sprocket is under full load tension. Therefore, the chain is fully loaded when flexed or swung laterally. Slack which develops in the chain is collected immediately behind the drive sprocket. The concentration of slackened chain results in skipping of the chain if allowed to run with such an accumulation of slack. Therefore, it is desirable to drive the conveyor from the rear sprocket so that only the upper run is tensioned, and the wear and noise level is substantially reduced. By driving the conveyor from the rear sprocket and positioning an idler roller assembly at the front of the conveyor, the conveyor may be positioned closer to the gathering device to carry out a more efficient gathering operation. However, by the nature of spring take-up devices to maintain the prescribed minimum tension on the conveyor when it is swung, necessitates that an excessive amount of tension be applied to the conveyor thorugh the driven rear sprocket when the conveyor portions are aligned. It has been suggested to position spring take-up devices on the front roller assembly particularly for boring type continuous miners, but the limited area for such devices at the front of the conveyor in view of the problem of positioning the gathering device as close as possible to the front of the conveyor prevents such an arrangement.

There is need to provide a conveyor for a continuous mining machine in which a preselected tension is maintained on the conveyor to prevent slack from developing in the conveyor when it is swung laterally. The tension on the elements of the conveyor when the conveyor portions are aligned must not exceed the tension required to maintain the conveyor free of slack when swung in order to avoid excessive wear of the conveyor components and generation of unacceptable levels of noise when the conveyor is operating. Furthermore, there is need for a continuous mining machine conveyor that is driven from the rear sprocket to facilitate positioning the front sprocket relative to the gathering device for an efficient gathering operation.

SUMMARY OF THE INVENTION

In accordance with the present invention there is provided a mining machine conveyor and apparatus for controlling the tension thereon that includes a mining machine body portion mounted on devices for propelling the body portion. A conveyor support frame extends longitudinally on the body portion. A laterally flexible continuous conveyor is positioned on the conveyor frame. The conveyor has a receiving end portion and a laterally pivotal discharging end portion. A front roller assembly and a rear roller assembly rotatably support the conveyor at the receiving end portion and at the discharging end portion respectively. The front roller assembly is immovably positioned on the conveyor support frame, and the rear roller assembly is positioned for longitudinal movement on the conveyor support frame. A conveyor drive mechanism is mounted on the conveyor support frame adjacent the discharging end portion and is drivingly connected to the rear roller assembly. The conveyor drive mechanism is operable to rotate the conveyor at a preselected speed from the receiving end portion to the discharging end portion. An extensible device is supported by the conveyor support frame and is connected to the rear roller assembly. The extensible device is operable to maintain a preselected tension on the conveyor and to remove slack therein as the discharging end portion pivots laterally.

The extensible device includes a pair of take-up cylinders each rigidly secured to the conveyor support frame and having slidably retained therein, a rod member having a large diameter end portion and a small diameter end portion forming a shoulder of a differential area against which fluid pressure is exerted to extend the rod from the cylinder. Fluid under pressure is supplied to the cylinders from the hydraulic circuit of the conveyor drive motor. Therefore, the pressure of the fluid supplied to the cylinders of the extensible device is proportional to the fluid pressure applied to the motors. Thus, a change in the operating pressure of the conveyor motor is accompanied by a corresponding change in the fluid pressure within the take-up cylinders.

The large diameter end portion of the rod of each take-up cylinder is rigidly connected to a movable frame assembly that is positioned for slidably longitudinal movement on the conveyor support frame. Extension and retraction of the rod of the cylinder advances the frame assembly on the conveyor support frame. The movable frame assembly is positioned adjacent the rear roller assembly on the conveyor support frame in underlying relationship with the conveyor. The movable frame assembly is connected at the opposite end portions thereof to the rear roller assembly. Actuation of the take-up cylinders to extend or retract the rods therein advance or retract the movable frame assembly on the conveyor support frame. In this manner the rear roller assembly that transmits rotation to the conveyor at the discharging end portion is moved longitudinally by the take-up cylinders.

The tension in the conveyor is controlled by the take-up cylinders to provide a uniform tension when the conveyor discharging end portion is in a first position aligned with the receiving end portion and when the discharging end portion is in a second position pivoted laterally relative to the receiving end portion. Thus, slack which normally occurs in the conveyor when the discharging end portion is pivoted laterally is removed by operation of the take-up cylinders which are responsive to the operating pressure of the conveyor drive motor.

The conveyor drive motor maintains a uniform rotational speed of the conveyor chain around the front and rear roller assemblies. To accommodate an increase in the load exerted upon the conveyor when swung laterally, the operating pressure of the drive motor increases to maintain the preselected conveyance speed. By connecting the take-up cylinders to the circuitry of the conveyor drive motor, an increase in the operating pressure of the motor is accompanied by an increase in the fluid pressure within the take-up cylinders by an amount to counteract the slack in the conveyor associated with an increase in the load on the conveyor drive motor when the conveyor boom is swung laterally. Thus, the pressure exerted by the take-up cylinders upon the rear roller assembly to maintain the conveyor free of slack is proportional to the operating pressure of the conveyor drive motor. Thus, only that tension which is required to maintain the conveyor chain free of slack is applied to the conveyor chain. In this manner the conveyor chain is not excessively preloaded when the discharging end portion is aligned with the receiving end portion.

To accommodate the maximum operating pressure of the conveyor drive motor and provide a durable take-up cylinder capable of withstanding the stresses of a large continuous mining machine, the rod of the cylinder has adjoining large and small diameter portions. The difference in the diameter of the rod portions represents the required differential area to provide displacement of the rod for a maximum fluid pressure in the range between about 3000 to 5000 p.s.i. With this rod configuration, the take-up cylinder of the present invention is equivalent to a cylinder of about 1 square inch but the rod and cylinder are substantially larger and sufficiently durable to withstand the punishment of a large continuous mining machine.

Accordingly, the principle object of the present invention is to provide a take-up cylinder for a continuous flexible conveyor of a mining machine to maintain a preselected tension on the conveyor and eliminate slack in the conveyor when pivoted laterally.

A further object of the present invention is to provide a take-up cylinder for a mining machine conveyor with the cylinder operating at a pressure proportional to the operating pressure of the conveyor drive motor so that the force exerted upon the conveyor chain is only that force which is necessary to maintain the conveyor chain free of slack.

Another object of the present invention is to provide a hydraulically operated take-up cylinder for controlling the tension on a mining machine conveyor in which the conveyor is driven by a hydraulic motor that is drivingly connected to a rear roller assembly that is longitudinally movable by operation of the take-up cylinder.

Another object of the present invention is to provide a durable, hydraulically operated take-up cylinder for a mining machine conveyor that is responsive to the operating pressure of the conveyor drive motor that propels the rear conveyor sprocket to maintain a minimum tension on the conveyor and prevent slack from developing in the conveyor.

These and other objects of the present invention will be more completely described and disclosed in the following specification, the accompanying drawings and the appended claims.

DESCRIPTION OF THE PREFERRED EMBODIMENT

Figure 1:
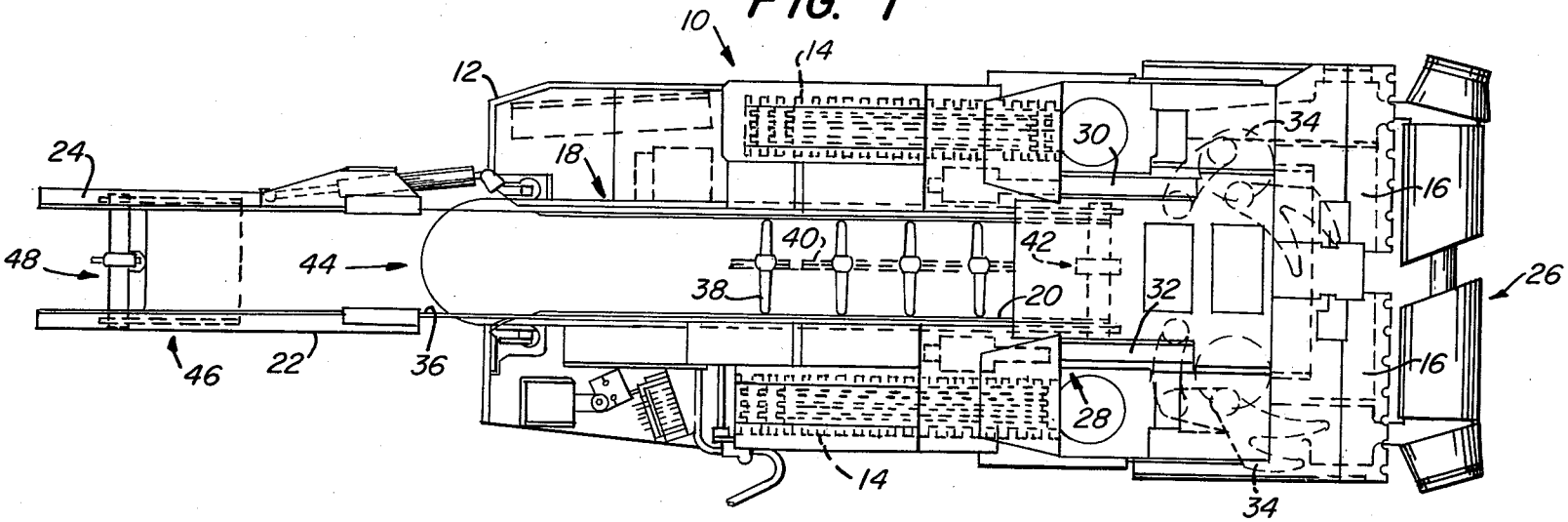
FIG. 1 is a top plan view of a continuous mining machine having a longitudinal flight-type conveyor with a pivotal discharging end portion and a conveyor take-up cylinder of the present invention.
Figure 2:
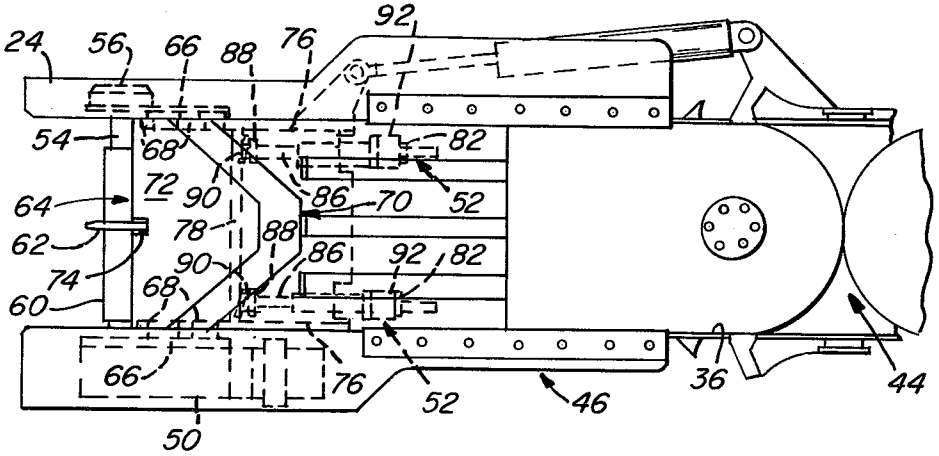
FIG. 2 is an enlarged fragmentary top plan view of the conveyor pivotal discharging end portion, illustrating the conveyor take-up cylinder connected to a driven rear conveyor sprocket.
Figure 3:
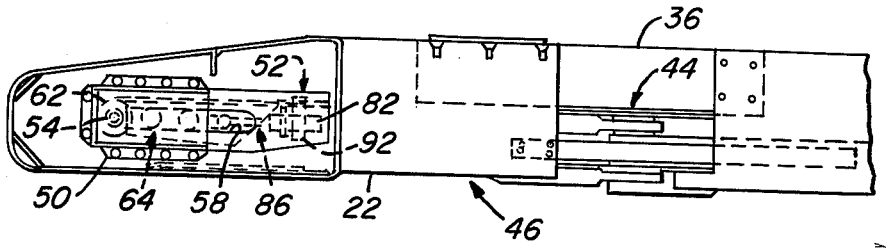
FIG. 3 is a view in side elevation of the conveyor pivotal discharging end portion illustrated in FIG. 2.

Referring to the drawings and particularly to FIGS. 1, 2 and 3, there is illustrated a mining machine generally designated by the numeral 10 that has a body or frame portion 12 suitably mounted on propelling devices 14, such as endless crawler tracks. Hydraulic motors 16 are provided to propel the mining machine 10 on the endless crawing tracks 14 to advance the mining machine during mining operation. A laterally flexible endless conveyor mechanism 18 is positioned in a longitudinal trough member 20 formed by a conveyor support frame generally designated by the numeral 22 that extends longitudinally on the body portion 12. The conveyor mechanism 18 conveys material dislodged by the mining machine 10 from the front to a pivotal discharging end portion 24 of the conveyor.

A cutting element 26, such as a drum member, is rotatably mounted on the front end of a boom member 28 having a pair of parallel rearwardly extending arm members 30 and 32 that are pivotally connected to the mining machine body portion 12. Piston cylinder assemblies are pivotally connected at one end portion to the mining machine body portion 12 and at the other end to the boom arm members 30 and 32 so that upon actuation of the piston cylinder assemblies the boom member 26 is moved through the arm members 30 and 32 vertically upwardly. The drum member has cutting elements extending therefrom so that a shear cut is made by the drum member 26 as the mining machine 10 advances the drum into the mine face.

Solid material dislodged from the mine face by the cutting action of the drum member is gathered from the mine floor by a gathering device 34 that extends forwardly from the body portion 12. The gathering device 34 gathers the dislodged material and feeds the material rearwardly onto the conveyor trough 20 so that the dislodged material is conveyed rearwardly by the endless conveyor mechanism 18 to the discharging end portion 24. The scope of the present invention does not include the operation of the cutter drum member 26 of the mining machine 10 which is explained in greater detail in U.S. Pat. No. 3,774,969.

The trough 20 is positioned between spaced, parallel, flexible conveyor sidewalls 36 that extend upwardly from the conveyor support frame 22. The conveyor mechanism 18 is a flexible flight-type, endless chain conveyor that includes a plurality of longitudinally spaced flights 38 connected by lengths of chain 40, in a conventional manner, to permit the lengths of chain 40 to flex laterally about their connections to the flights 38. The front of the conveyor 18 is reeved about and rotatably supported by idler roller assembly 42.

The conveyor support frame 22 at the discharging end portion 24 includes a conveyor boom 46 that is arranged to swing laterally about conveyor swivel section 44 in a preselected direction at the rearward end portion of the mining machine 10. The conveyor boom 46 rotatably supports the conveyor discharging end portion 24 about a driven roller assembly 48, such as a driven sprocket. The driven roller assembly 48 is drivingly connected to a hydraulically operated conveyor drive motor (not shown) through a conveyor drive gear assembly 50 that is movably positioned on the conveyor boom 46. With this arrangement the drive sprocket 48 that rotatably supports the end of the continuous conveyor 18 is driven to rotate the conveyor in a direction from the receiving portion to the discharging end portion so that the dislodged material fed by the gathering device onto the receiving end portion of the conveyor 18 is advanced rearwardly on the mining machine to the discharging end portion 24. The dislodged material is transferred from the discharging end portion 24 onto a conventional section belt or into a suitable haulage vehicle for removal of the dislodged material from the mine.

As the conveyor boom 46 pivots about the conveyor swivel section 44 to swing the discharging end portion 24 laterally, the effective length of the conveyor chain is changed producing slack in the chain. The slack is removed from the chain during the pivotal movement thereof by operation of the take-up cylinders 52 that are hydraulically operated to exert a preselected pressure on the driven roller assembly 48 and thereby maintain a preselected tension on the conveyor chain 40 and remove slack that occurs in the chain 40 when swung laterally.

Figure 5:
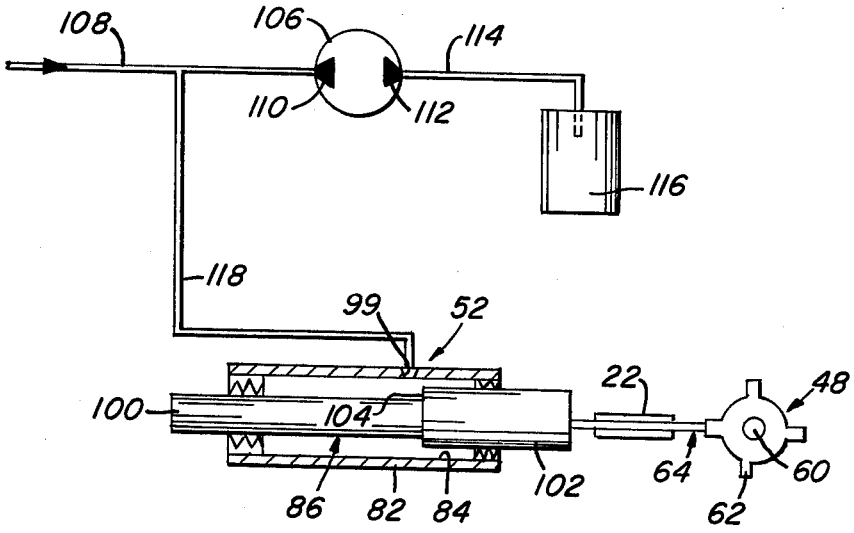
FIG. 5 is a hydraulic schematic, illustrating the conveyor take-up cylinder connected to the pressure side of the conveyor drive motor so the force exerted by the take-up cylinder upon the rear conveyor sprocket is proportional to the operating pressure of the drive motor.

As will be explained later in greater detail, the take-up cylinders 52 are connected to the hydraulic circuitry of the conveyor drive motor as illustrated in FIG. 5. With this arrangement the pressure exerted by the take-up cylinders 52 is proportional to the operating pressure of the conveyor drive motor so that the take-up cylinders exert upon the driven roller assembly 48 a force proportional to the motor operating pressure to maintain the conveyor chain 40 free of slack when the conveyor boom is straight and swung laterally. Thus, the tension exerted on the conveyor chain varies as the load on the conveyor drive motor varies. In this manner, it is not necessary to excessively tension the conveyor chain when the conveyor portions are aligned in order to prevent slack developing when the conveyor boom is swung laterally as with conventional spring operated take-up devices.

When the discharging end portion 24 is aligned with the main portion of the conveyor, the conveyor chain 40 is not excessively preloaded by the take-up cylinders 52. This avoids subjecting the conveyor chain components to the stresses that are normally applied to a conveyor chain by conventional spring take-ups, which as stated above, exert more tension than required when the conveyor portions are aligned so that the conveyor may remain free of slack when the conveyor boom is swung laterally. Furthermore, by avoiding preloading the conveyor chain 40, the wear associated therewith on the chain components and the noise generated therefrom is substantially reduced.

As illustrated in FIGS. 2 and 3 the conveyor mechanism 18 is driven at the discharging end portion 24 by a hydraulic motor that is drivingly connected through the conveyor drive gear assembly 50 to the roller assembly 48. It will be apparent that by driving the conveyor from the rear sprocket as opposed to the front sprocket 42, more space is available for positioning the sprocket 42 closely adjacent to the gathering device 34. This provides for a more efficient gathering operation and feeding of the conveyor mechanism 18. Furthermore, by driving the conveyor from the rear, the entire mechanism 18, i.e., the chain 40 from the front roller assembly 42 to the rear roller assembly 48 and back through the return pan of the conveyor, is not fully loaded as when the conveyor is driven from the front. Also, with a rear driven conveyor it is possible to avoid "bunching" of the chain immediately behind the front roller assembly and the problems associated therewith.

The rear roller assembly 48 extends transversely between the conveyor sidewalls 36 and is longitudinaly movable within the conveyor support frame 22. The roller assembly 48 includes a conveyor drive shaft 54 that is drivingly connected to the drive gear assembly 50 at one end portion and rotatably supported within the conveyor support frame 22 by take-up bearing block 56 at the other end portion. The end portions of the drive shaft 54 extend through longitudinal slots 58 in a wall of the conveyor support frame 22. With this arrangement the drive gear assembly 50 and drive shaft 54 are positioned for longitudinal movement on the support frame to facilitate adjustments in the conveyor chain tension. A sprocket shaft 60 is nonrotatably secured to the drive shaft 54 and includes a sprocket member 62 about which the conveyor chain 40 is reeved as the chain 40 passes around the discharging end portion 24 and back in a return run to the receiving end portion of the conveyor mechanism 18.

The drive shaft 54 and the drive sprocket 60 and movably supported on the conveyor support frame 22 by a movable frame assembly generally designated by the numeral 64 that is rigidly connected to the hydraulic take-up cylinders 52. The end portions of the drive shaft 54 are rotatably supported in slide brackets 66 of the frame assembly 64. The slide brackets 66 are positioned adjacent the conveyor sidewalls 36 opposite the longitudinal slots 58. The slide brackets 66 are longitudinally movable relative to the sidewalls 36 and include stub shafts 68 that extend inwardly from the slots 58. The stub shafts 68 are, in turn, rigidly secured to a slide block 70 of the movable frame assembly 64.

The slide block 70 is movably supported on the conveyor support frame 22 adjacent the conveyor sidewalls 36 and is rigidly connected to the take-up cylinders 52. Actuation of the take-up cylinders 52 advances and retracts the slide block 70 on the conveyor support frame 22 to longitudinally advance or retract the slide brackets 66. In this manner the drive gear assembly 50 and the drive shaft 54 connected to the slide brackets 66 are operable to move longitudinally on the conveyor support frame 22. Accordingly, by longitudinally moving the drive gear assembly 50 and the drive shaft 54 the tension on the conveyor chain 40 may be adjusted as the conveyor boom 46 is swung from alignment with the main portion of the conveyor to a position laterally thereof.

The slide block 70, as illustrated in FIG. 2, includes a horizontal plate member 72 that is movably supported on the discharging end portion 24 of the conveyor support frame 22 and has a recess 74 for receiving the sprocket member 62. A pair of longitudinally extending members 76 are secured to the plate 72 and extend forwardly of the drive shaft 54 on the conveyor support frame 22. The longitudinal members 76 include openings for receiving the stub shafts 68 which are pinned to the members 76 to permit movement of the slide brackets 66 with the longitudinal members 76. A transverse member 78 extends between the longitudinal members 76 and a pair of sockets are secured thereto. The sockets provide a means for connecting the slide block 70 to the take-up cylinders 52.

Figure 4:
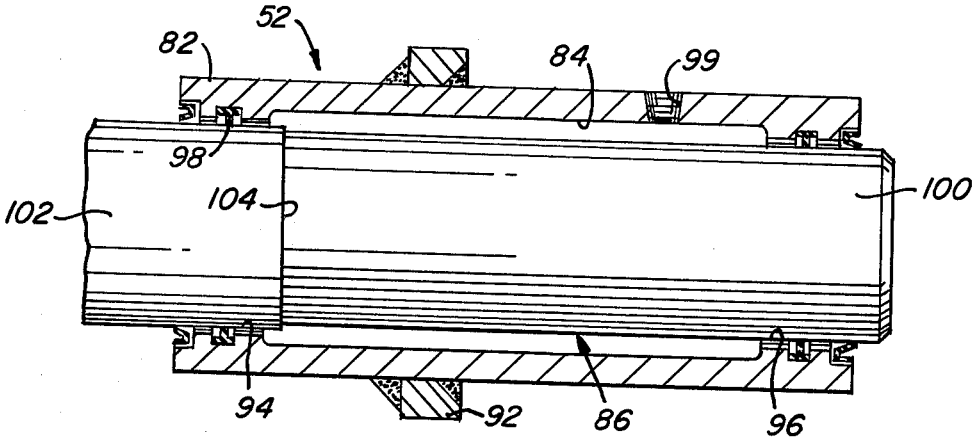
FIG. 4 is an enlarged fragmentary sectional view of the conveyor take-up cylinder, illustrating an extensible rod positioned within the cylinder and having a preselected differential area to transmit a force upon the rear conveyor sprocket to maintain a preselected tension on the conveyor and eliminate slack therein.

The take-up cylinders 52 each include a cylinder 82, as illustrated in FIG. 4, having an internal bore 84 with an extensible rod member 86 movably positioned in the bore 84 for extension and retraction relative thereto. The end portion of the rod 86 is rigidly secured within a respective socket on the transverse member 78. The end portion of the rod 86 includes a radial flange 88 spaced from the socket. A Belleville spring assembly 90 surrounds the end of the rod 86 with the end portions of the spring abutting the socket and the flange 88. With this arrangement, extension of the rod 86 from the cylinder 82 compresses the Belleville springs 90 and rearwardly moves the slide block 70 on the conveyor support frame 22. The rearward movement of the slide block 70 is transmitted through the stub shafts 68 to the slide brackets 66 and the roller assembly 48.

Accordingly, retraction of the rod 86 within the cylinder 82 urges the slide block 70 to move forwardly on the support frame 22 and through the slide brackets 66 to move the roller assembly 48 forwardly on the conveyor support frame 22. Operation of the Belleville springs 90 maintains the rod 86 of each of the take-up cylinders 52 in a normally retracted position with the cylinder 82.

Each of the take-up cylinders 52 includes, as illustrated in FIG. 4, a collar 92 that surrounds and is secured to the cylinder portion 82. The collar 92 is secured to the conveyor support frame 22 to rigidly position the take-up cylinder 52 on the conveyor discharging end portion 24. The internal bore 84 of the cylinder 82 is unfinished as compared to the bore of a conventional double action piston cylinder assembly. The rod member 86 extends through openings 94 and 96 of the cylinder 82 and seal rings 98 secured to the cylinder 82 surround the rod member to seal the internal portion of the cylinder. The cylinder 82 also includes an inlet 99 for connection to a hydraulic line that supplies fluid under pressure from a pump (not shown) into the cylinder 82. The hydraulic circuitry for the take-up cylinders and the conveyor drive motor is illustrated in FIG. 5 and will be described in further detail.

The rod 86 is slidably retained within each cylinder 82 and is maintained in a normally retracted position as above discussed by the Belleville spring assembly 90. The rod 86 includes a small diameter end portion 100 that is slidably supported by the seal members within opening 96 and a large diameter end portion 102 that is slidably supported by seal members 98 within opening 94. The juncture of the large and small diameter portions 100 and 102 form a shoulder 104 of a preselected surface area against which the pressurized fluid within the bore 84 is applied. Preferably, the surface area of the shoulder 104 is between about 0.5 to 0.9 square inch and thus approximates a bore of about 1 square inch. A bore of this area is preferred in order to accommodate a fluid pressure in the range between 3000 to 5000 p.s.i. which corresponds to the operating pressure range of the hydraulic conveyor motor that drives the rear sprocket 62.

As stated hereinabove, the take-up cylinders 52 are connected to the pressure side of the hydraulic conveyor motor so that the take-up cylinders operate at the hydraulic pressure of the conveyor drive motor. Thus, the take-up cylinders are load sensitive, and the fluid pressure exerted upon the shoulder 104 of each cylinder is proportional to the operating pressure of the conveyor drive motor.

For a take-up cylinder to operate within the above pressure range would require a cylinder bore of approximately 1 square inch. A bore of this size is not capable of withstanding the stresses generated by the operation of a large continuous mining machine. Therefore, to overcome the limitations of a small take-up cylinder, the preferred displacement area is obtained by the take-up cylinder of the present invention. By providing a rod having portions of unequal diameter a differential area is provided for exposure to the fluid pressure that approximates the displacement of a smaller cylinder. It will be apparent that the take-up cylinder of the present invention may be constructed of the size required to meet the stresses of operation of the continuous mining machine and accommodate the operating range of the conveyor drive motor without use of reducing valves and the like.

The rod 86 is of a substantial size in which the area of the shoulder 104, being the difference between the diameters of rod portions 102 and 100, provides the pressure surface for generating a force on the drive shaft 54 to maintain the conveyor chain 40 free of slack. Even though the relative dimensions of the cylinder 82 and the rod portions 100 and 102 are large in comparison with the area of shoulder 104, the relative difference between the diameter of the rod portions 100 and 102 provides the desired displacement area for operating at a maximum pressure within the range between about 3000 to 5000 p.s.i. In this respect, the hydraulic take-up cylinders 52 are so constructed by the configuration of the rod 86 that the cylinders essentially equate a cylinder of about 1 square inch.

Referring to FIG. 5, each of the take-up cylinders 52 is connected to the hydraulic circuitry that supplies pressurized fluid to a conveyor drive motor 106 that propels the drive shaft 54 and the drive sprocket shaft 60 and sprocket 62 connected thereto. A pump on the mining machine body portion 12 supplies the fluid through conduit 108 to the drive side 110 of conveyor drive motor 106, which is a conventional hydraulically operated motor. The fluid is vented from motor 106 through outlet 112 and is discharged through conduit 114 to return tank 116. The take-up cylinder 52 which is representative of the take-up cylinder of the present invention is connected to conduit 108 by conduit 118 which is connected to the inlet 99 of the cylinder 82. With this arrangement, pressurized fluid is directed into the cylinder 82 at a pressure which is proportional to the fluid pressure supplied to the drive side 110 of conveyor drive motor 106. Thus, the take-up cylinder 52 is load sensitive and operates at a pressure corresponding to the operating pressure of conveyor drive motor 106.

As will be apparent from the present invention, the connection of the take-up cylinder 52 to the hydraulic circuitry of the conveyor drive motor 106 is accomplished without the need of pressure reducing valves to permit the application of a reasonably sized hydraulically operated take-up cylinder on a large mining machine. By eliminating the need for pressure reducing valves the problems of valve adjustment and maintenance are eliminated. Thus, with the present invention, a reliable and substantially maintenance free take-up system is provided to generate the desired pressure upon the conveyor chain 40 as determined by the specifications of the hydraulic motor 106, conveyor drive gear assembly 50 and sprocket member 62.

The take-up cylinder 52 responds to the operating pressure of the conveyor motor 106 to generate a force upon the conveyor chain that is sufficient to counteract the slack which develops in the chain 40 when the conveyor boom 46 is swung laterally about the conveyor swivel section 44. When the conveyor boom 46 is aligned with the main portion of the conveyor mechanism 18, the motor 106 operates at a first fluid pressure. The pressure generated within the cylinder 82 and applied to the shoulder 104 of the rod 86 is proportional to the first fluid pressure. The fluid pressure acting upon shoulder 104 extends rod 86 from the cylinder 82 to urge the movable frame assembly 64 to move rearwardly on the conveyor support frame 22. Thus, any slack present in the conveyor chain 40 is taken up by the rearward force exerted by the sprocket 62 upon the conveyor chain 40 reeved therearound. The cylinder 52 communicating with the conveyor drive hydraulic circuit exerts upon the conveyor chain 40 a pressure which is proportional to the operating pressure of the motor 106.

During lateral swinging movement of the boom member 28 about the conveyor swivel section 44, the effective length of the conveyor mechanism 18 is changed. Without the presence of a take-up cylinder slack will develop in the conveyor chain 40. Also, the load upon the conveyor drive motor 106 is increased requiring that the motor operate at a greater speed. The demand for an increase in the motor speed is met by an increase in the fluid pressure supplied to the motor 106 through conduit 108 so that the motor operates at a second fluid pressure. An increase in the operating pressure of conveyor drive motor 106 is accompanied by a proportional increase in the operating pressure of the take-up cylinders 52 by virtue of the connection of cylinders 82 with conduit 108. An increase in the fluid pressure upon shoulder 104 of the rod 86 extends the rod from the cylinder compressing the Belleville spring assembly 90, illustrated in FIG. 2, to rearwardly advance the movable frame assembly 64 and increase the tension applied to the conveyor chain 40 through the sprocket member 62. In this manner slack developing in the conveyor chain 40 during lateral swinging movement is taken up.

The increase in force exerted upon the chain 40 as it is swung laterally is directly proportional to the increase in load on the conveyor motor 106 so that the force exerted upon the conveyor chain 40 to maintain the chain 40 free of slack varies with the fluid pressure required to drive the motor 106. This eliminates wear of the chain 40 associated with applying a tension that exceeds the minimum tension to maintain the chain 40 free of slack when the chain portions are aligned and when the chain is swung laterally. When the conveyor boom 28 is restored to a position of alignment with the main portion of the conveyor mechanism 18, the load upon the conveyor motor is reduced. In response to the reduction in load upon the motor 106, the operating pressure of the motor and the take-up cylinders 52 is reduced. Consequently, the rod 86 retracts within the cylinder 82. By operation of the Belleville spring assembly 90, the rod 86 is restored to its normal position with cylinder 82.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A mining machine conveyor and apparatus for controlling the tension thereon comprising, a mining machine body portion mounted on means for propelling said body portion, a conveyor support frame extending longitudinally on said body portion, an endless laterally flexible continuous conveyor positioned on said conveyor support frame, said conveyor support frame having a laterally pivotal discharging end portion and a receiving end portion, front roller means for rotatably supporting said endless conveyor at said conveyor frame receiving end portion and rear roller means for rotatably supporting said endless conveyor at said conveyor frame discharging end portion, said front roller means being fixedly mounted on said conveyor support frame receiving end portion and said rear roller means being mounted on said conveyor support frame discharging end portion for longitudinal movement thereon, a hydraulic conveyor drive motor mounted on said conveyor support frame and drivingly connected to said rear roller means for moving portions of said endless conveyor at a preselected speed from said receiving end portion to said discharging end portion, extensible means supported by said conveyor support frame and connected to said rear roller means for maintaining a preselected tension on said endless conveyor and to remove slack therein, a hydraulic circuit for transmitting fluid under pressure to said hydraulic conveyor drive motor to actuate said hydraulic conveyor drive motor to move portions of said endless conveyor at a preselected speed from said receiving end portion to said discharging end portion, and conduit means for connecting said hydraulic circuit to said extensible means to supply fluid under pressure thereto and actuate said extensible means so that the pressure exerted by said extensible means upon said rear roller means is proportional to the operating pressure of said hydraulic conveyor drive motor.

2. The mining machine conveyor and apparatus for controlling the tension thereon as set forth in claim 1 which includes, said extensible means including a cylinder having an opening for receiving said conduit means to direct fluid under pressure into said cylinder, a rod member extending through said cylinder and movably positioned therein, said rod member being rigidly connected to said rear roller means and having a large and small diameter portion forming a circumferential shoulder on said rod member, and said shoulder having a preselected area against which the pressurized fluid is exerted to extend said rod member from said cylinder and thereby displace said rear roller.

3. The mining machine conveyor and apparatus for controlling the tension thereon as set forth in claim 2 which includes, said shoulder having an area of about one square inch to receive a maximum fluid pressure in the range between about 3000 p.s.i. to 5000 p.s.i. corresponding to the operating pressure of said hydraulic conveyor drive motor.

4. The mining machine conveyor and apparatus for controlling the tension thereon as set forth in claim 1 which includes, a frame assembly positioned for longitudinal movement on said conveyor support frame in underlying relation with said endless conveyor between said extensible means and said rear roller means, said frame assembly being connected at one end portion to said extensible means and at the other end portion to said rear roller means, and said frame assembly arranged to move rearwardly on said conveyor support frame upon actuation of said extensible means to rearwardly move said rear roller means and thereby exert a force upon said rear roller means proportional to the operating pressure of said hydraulic conveyor drive motor.

5. The mining machine conveyor and apparatus for controlling the tension thereon as set forth in claim 4 in which said movable frame assembly includes, a slide block rigidly connected to said extensible means and supported for longitudinal movement on said conveyor support frame at said discharging end portion, a pair of slide brackets positioned laterally of and connected to said slide block, and said slide brackets being connected to the end portions of said rear roller means to support said rear roller means for longitudinal movement on said conveyor support frame discharging end portion.

6. The mining machine conveyor and apparatus for controlling the tension thereon as set forth in claim 1 which includes, a pair of longitudinal slots positioned in said conveyor support frame discharging end portion, said rear roller means including a drive shaft extending through said longitudinal slots and drivingly connected at one end to said hydraulic conveyor drive motor and rotatably supported at the other end, a sprocket shaft nonrotatably positioned on said drive shaft, a sprocket member secured to said sprocket shaft for rotation with said drive shaft, and said sprocket member arranged to rotatably support said endless conveyor at said discharging end portion so that rotation of said drive shaft rotates said endless conveyor from said receiving end portion to said discharging end portion.

7. The mining machine conveyor and apparatus for controlling the tension thereon as set forth in claim 1 in which said extensible means includes, a cylinder having an internal bore, a rod member movably supported within said bore for extension and retraction relative to said cylinder, said rod member having an end portion connected to said rear roller means and a large and small diameter portion, a circumferential shoulder formed on said rod member at the juncture of said rod large and small diameter portions, said shoulder having a preselected surface area, an inlet in said cylinder for receiving fluid at a preselected pressure, and said shoulder being operable as a displacement surface for said fluid so that when said rod member is extended from said cylinder a rearward force is exerted on said rear roller means to thereby apply a force on said endless conveyor proportional to the operating pressure of said hydraulic conveyor drive motor when said discharging end portion is in a first position aligned with said receiving end portion and in a second position pivoted laterally relative thereto.

8. The mining machine conveyor and apparatus for controlling the tension thereon as set forth in claim 7 which includes, resilient means contacting said rod member for maintaining said rod member in a normally retracted position within said cylinder to exert a preselected tension on said conveyor when said receiving and discharging end portions are aligned, and said rod arranged to extend from said cylinder and compress said resilient means to rearwardly move said rear roller means and increase the tension on said conveyor when the operating pressure of said hydraulic conveyor drive motor increases when said discharging end portion is pivoted laterally.

9. The mining machine conveyor and apparatus for controlling the tension thereon as set forth in claim 1 which includes, gathering means for feeding dislodged material onto said conveyor receiving end portion, and said front roller assembly positioned on said conveyor support frame to rotatably support said endless conveyor at said receiving end portion closely adjacent to said gathering means to effect efficient feeding of dislodged material onto said endless conveyor.

* * * * *